US010132228B1

(12) United States Patent
Myers et al.

(10) Patent No.: US 10,132,228 B1
(45) Date of Patent: Nov. 20, 2018

(54) COOLING SYSTEM FOR AN ENGINE

(71) Applicants: HYUNDAI MOTOR COMPANY, Seoul (KR); KIA MOTORS CORPORATION, Seoul (KR)

(72) Inventors: John Myers, Howell, MI (US); Scott Sarnia, Newport, MI (US)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 15/686,363

(22) Filed: Aug. 25, 2017

(51) Int. Cl.

| | |
|---|---|
| ***F01P 7/00*** | (2006.01) |
| ***F01P 7/16*** | (2006.01) |
| ***F01P 5/10*** | (2006.01) |
| ***F01P 3/02*** | (2006.01) |

(52) U.S. Cl.
CPC ..... *F01P 7/165* (2013.01); *F01P 3/02* (2013.01); *F01P 5/10* (2013.01); *F01P 2003/021* (2013.01); *F01P 2003/024* (2013.01); *F01P 2003/027* (2013.01)

(58) Field of Classification Search
CPC ..... G05D 23/134; G05D 23/1333
USPC ..... 123/41.02, 41.1, 41.08, 41.14
See application file for complete search history.

(56) References Cited

U.S. PATENT DOCUMENTS

| | | | | |
|---|---|---|---|---|
| 6,499,442 | B2 * | 12/2002 | Hollis | F01P 5/10 123/41.1 |
| 7,096,830 | B2 * | 8/2006 | Hollis | F01P 5/12 123/41.08 |
| 2006/0157002 | A1 * | 7/2006 | Pfeffinger | F01P 7/162 123/41.29 |
| 2007/0144464 | A1 * | 6/2007 | Muller | F01P 3/02 123/41.29 |
| 2009/0205590 | A1 * | 8/2009 | Vetrovec | F01P 11/20 123/41.14 |
| 2011/0259287 | A1 * | 10/2011 | Kakehashi | F01P 7/164 123/41.09 |
| 2012/0210954 | A1 * | 8/2012 | Nishikawa | F01P 3/02 123/41.08 |
| 2013/0221116 | A1 * | 8/2013 | Tsuchiya | F01P 7/14 236/34.5 |

* cited by examiner

*Primary Examiner* — Marguerite McMahon
*Assistant Examiner* — James Kim
(74) *Attorney, Agent, or Firm* — Brinks Gilson & Lione

(57) ABSTRACT

A cooling system for an engine may include: a coolant pump having a main inlet, a bypass inlet, a first outlet to supply coolant to an engine block, and a second outlet to supply coolant to an engine head; a main thermostat to control the flow of coolant discharged from the engine block and head; a bypass thermostat to selectively send the coolant discharged from the engine block to the bypass inlet of the coolant pump based on a temperature of the coolant discharged from the engine block; first and second coolant return lines to guide the coolant discharged from the engine head and block to the main thermostat; and a block coolant return line to directly connect the bypass thermostat to the bypass inlet of the coolant pump.

3 Claims, 5 Drawing Sheets

COOLING SYSTEM FOR AN ENGINE

FIELD

The present disclosure relates to a cooling system for an engine of a vehicle.

BACKGROUND

The statements in this section merely provide background information related to the present disclosure and may not constitute prior art.

A conventional internal combustion engine includes a block and a head, also known as an engine block and an engine head. The block of the engine is a casting with appropriate machined surfaces and threaded holes for attaching the head, a coolant pump (e.g., water pump), oil pan, and other units. In an automobile engine in general is equipped with a cooling system, which is designed to radiate the heat produced as a result of burning in the combustion chamber. The cooling system includes a series of channels (i.e, coolant lines) cast into the block and head, surrounding combustion chambers with circulating water or other coolant, and the coolant circulates through the channels in the block and head, respectively. This type of cooling system is referred as a separated cooling system.

In the conventional separated cooling system, a water pump is provided at a coolant circulating line to supply the coolant to the block and the head, and a radiator for radiating the heat of coolant discharged from the head and block is provided. And a main thermostat is disposed between in the coolant circulating line connecting the radiator and the water pump. The main thermostat controls the coolant supplied to the head and block via a water pump only when the temperature of the coolant is within a predetermined temperature range.

Meanwhile, a block thermostat for controlling flow of coolant discharged from the block is disposed in a cylinder-block-side coolant outlet line. The coolant, having passed through the block thermostat, is mixed with the coolant discharged from the head and supplied to the water pump. The cooling system also includes a bypass line connecting the block thermostat and the water pump. When the temperature of coolant discharged from the block is lower than a predetermined temperature, the block thermostat is closed so that coolant discharged from the coolant outlet line of the block is directly supplied to the water pump via the bypass line.

We have discovered that since the coolant discharged through the cylinder-block-side coolant outlet line is mixed with the coolant discharged from the head, engine warm up in a cold start condition is delayed and also large temperature gradient in the discharged coolant causes difficulties in controlling the temperature of coolant supplied to the block.

SUMMARY

The present disclosure provides a compact heat pump system for a vehicle to improve energy efficiency.

In one form, the present disclosure provides a cooling system for an engine having a head including a head coolant line, a block including a block coolant line for intake and discharge of coolant, and a plurality of channels through which coolant passes.

More specifically, the cooling system in one form of the present disclosure may include: a coolant pump mounted on the engine and having a main inlet, a bypass inlet, a first outlet configured to supply the coolant to the block, and a second outlet configured to supply the coolant to the head of the engine; a main thermostat configured to receive the coolant discharged from the block and head of the engine; a bypass thermostat configured to receive the coolant discharged from the block through the block coolant discharge line; a first coolant return line configured to guide the coolant discharged from the head and block to the main thermostat; a second coolant return line configured to connect the main thermostat to the main inlet of the coolant pump; and a block coolant return line configured to directly connect the bypass thermostat to the bypass inlet of the coolant pump. The bypass thermostat is configured to selectively send the coolant discharged from the block to the bypass inlet of the coolant pump based on a temperature of the coolant circulating in the block of the engine.

In one form, the outlet of the coolant pump may include a first outlet and a second outlet, and the coolant pump may have a joining area which is formed inside of the coolant pump and formed by a housing of the coolant pump and a mounting wall of the coolant pump. The joining area is configured to guide the coolant supplied through the bypass inlet to the engine block through the first outlet and to guide the coolant supplied through the main inlet to the engine head through the second outlet.

In one aspect of the present disclosure, the joining area may include a narrow neck portion configured to cause a Venturi syphon effect by which a small portion of the coolant flowing in through the main inlet is mixed with the coolant flowing in through the bypass inlet and supplied to the engine block.

In another form, the narrow neck portion may be formed by a raised portion of the housing adjacent to the bypass inlet, and the raised portion may be disposed between the main inlet and the bypass inlet.

In still another form, a cooling system for an engine having a head and a block may include: a plurality of channels through which coolant passes, the plurality of channels including a head coolant line formed in the head and a block coolant line formed in the block for intake and discharge of the coolant; a coolant pump mounted on the engine, and configured to separate coolant flowing in through a main inlet of the coolant pump from coolant flowing in through a bypass inlet of the coolant pump and to limit mixture of the coolant flowing in through the main inlet and the bypass inlet to a small amount based on a temperature of coolant discharged from the block; a main thermostat configured to control the coolant discharged from the block and head of the engine based on a temperature of the coolant discharged from the block and head; a bypass thermostat configured to control the coolant discharged from the block through the block coolant discharge line based on a temperature of the discharged block coolant; a first coolant return line configured to guide the coolant discharged from the head and block to the main thermostat; a second coolant return line configured to connect the main thermostat to the main inlet of the coolant pump; and a block coolant return line configured to directly connect the bypass thermostat to the bypass inlet of the coolant pump.

The bypass thermostat may be configured to selectively send the coolant discharged from the block to the bypass inlet of the coolant pump based on the temperature of the discharged block coolant.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
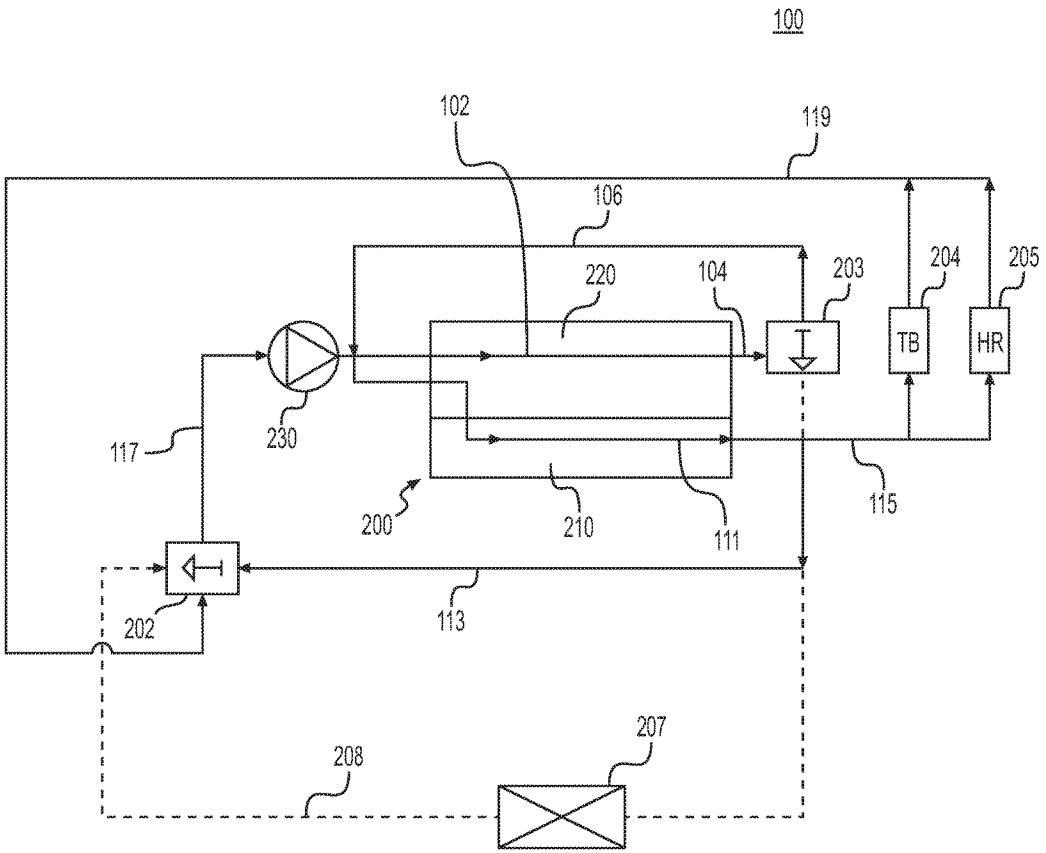
FIG. 1 is a schematic diagram of a cooling system for an engine.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

In the present disclosure, as illustrated in FIG. 1, a cooling system 100 for an engine 200 having a head 210 and a block 220 is provided. The head 210 includes a head coolant line 111, and the block 220 includes a block coolant line 102 for intake and discharge of coolant, respectively. The cooling system 100 includes: a plurality of channels 102, 111 through which coolant passes; a coolant pump 230 pumping coolant through the cooling system; a main thermostat 202 to receive the coolant discharged from the block 220 and head 210 of the engine 200; and a bypass thermostat 203 to receive the coolant discharged from the block 220 through the block coolant discharge line 104.

The cooling system 100 further includes a first coolant return line 113 to guide the coolant discharged from the head and block to the main thermostat 202, a second coolant return line 117 to connect the main thermostat 202 to the coolant pump 230, and a block coolant return line 106 to directly connect the bypass thermostat 203 to a bypass inlet 231 (in FIG. 3) of the coolant pump.

The plurality of channels 102, 111 formed in the block and head, respectively, may in a form of a water jacket. The coolant (e.g., a cooling water) flows through a coolant inlet formed in one of opposite ends of the block 220 with respect to a direction in which cylinder bores are arranged, into a cylinder block water jacket (hereinafter the block coolant line 102) surrounding the cylinder bores, and flows through the block coolant line to cool the block of the engine. Then, the cooling water may flow upward through a connecting port formed in an upper end part of the block into a cylinder head water jacket (herein after the head coolant line 111) surrounding combustion chambers, and flows through the head coolant line to cool the head 210. In one form, the coolant may flow into the head 210 through a separate coolant inlet formed in one of opposite ends of the head 210 with respect to a direction in which the combustion chambers are arranged.

As described in FIG. 1, a portion of coolant discharged from the head 210 may flow through a head coolant discharge line 115 and transfer heat to a throttle body 204 and a heater 205 while flowing through them. The coolant supplied to the throttle body 204 is used to warm up the throttle body, and the coolant supplied to the heater 205 is used for heating the inside of a vehicle (e.g., passenger cabin). The coolant passing through the throttle body and the heater is supplied to the coolant pump 230 via a third coolant return line 119.

Figure 2B:
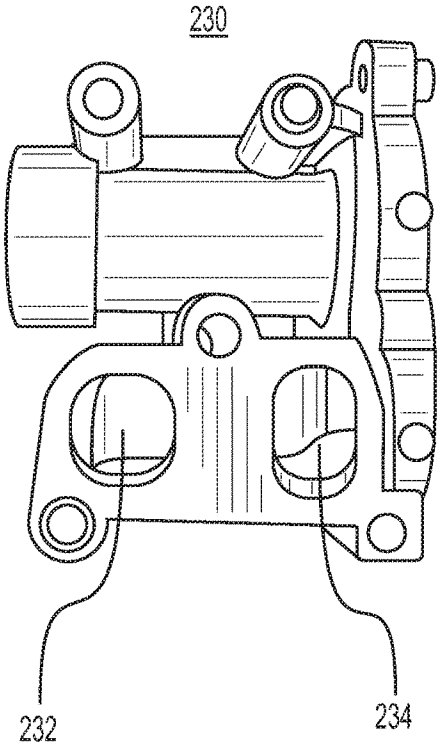
FIGS. 2A-2D are perspective views of a coolant pump in various angles.
Figure 2A:
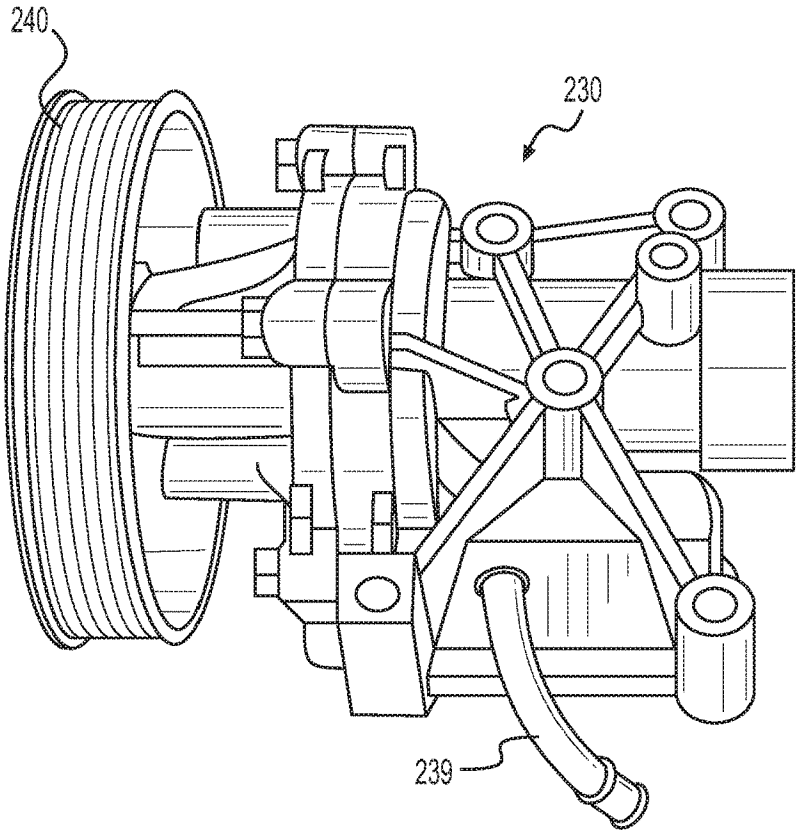
Figure 2D:
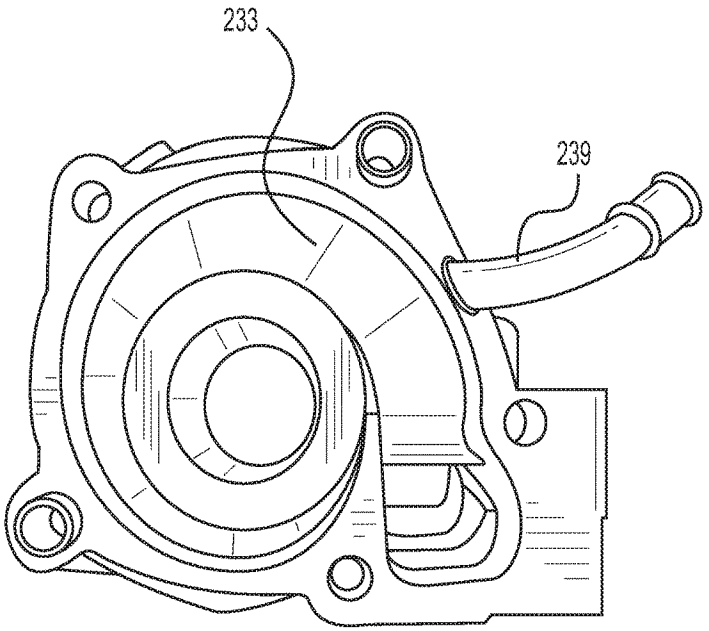
Figure 2C:
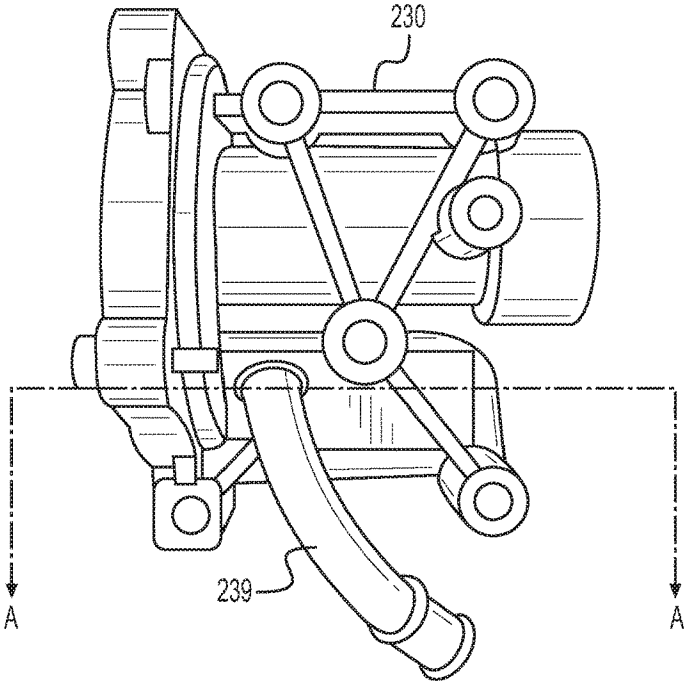

As illustrated in FIG. 2A, the coolant pump 230 has a pulley 240 by which rotational force of an engine is transferred to the coolant pump 230. FIG. 2A is a perspective view of the coolant pump 230 assembled with a pulley 240 which is rotated by rotational force of a crank shaft of an engine. The pulley 240 may be connected to the crank shaft via a belt to transfer the rotational force. FIGS. 2B-2D illustrate the coolant pump viewed from various angles as one form of the present disclosure. FIG. 2B shows first and second outlets 232, 234 formed in a portion mounted on the engine. The coolant is respectively supplied to the head and block of the engine through the first and second outlets 232 234.

In addition, FIGS. 2A, and 2C-2D illustrate a bypass inlet hose 239 communicating with the bypass inlet 231 (in FIG. 3) formed in inside of the coolant pump 230. Meanwhile, the bypass inlet hose 239 is connected to a block coolant return line 106 such that the coolant discharged through the block coolant discharge line 104 is directed to the bypass inlet 231 when the bypass thermostat 203 is closed to the head coolant discharge line 115. FIG. 2D is another view of the coolant pump 230 and shows a main inlet 233 where an impeller (not shown) of the water pump rotates to push the coolant to the engine. In general, the impeller of the coolant pump is disposed in a pump chamber and rotates as the pulley 240 rotates so that it circulates coolant in the cooling system 100.

In more detail, referring to FIGS. 2A-2C and FIG. 3, the coolant pump 230 may be mounted on one side of the block 220, in particular, on the same side on which the coolant inlets are formed in the block such that the coolant pump supplies coolant to the block and head through the coolant inlets, and the coolant circulates through the head coolant line 111 and the block coolant line 102. In another form, based on the structure of an engine, the coolant pump may be mounted on a side of the head 210. As described above, the coolant pump 230 is operated by the pulley 240 rotated by a crank shaft of an engine via a belt.

Figure 3:
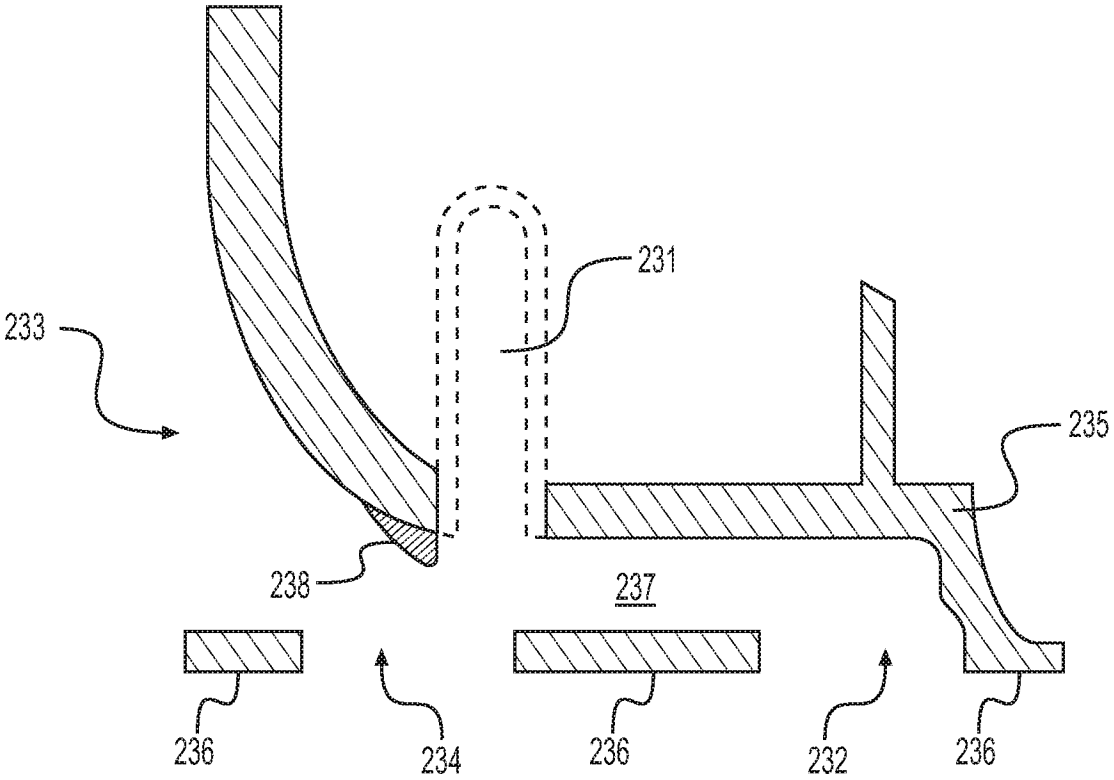
FIG. 3 is a cross-sectional view along line A-A in FIG. 2C.
Figure 4:
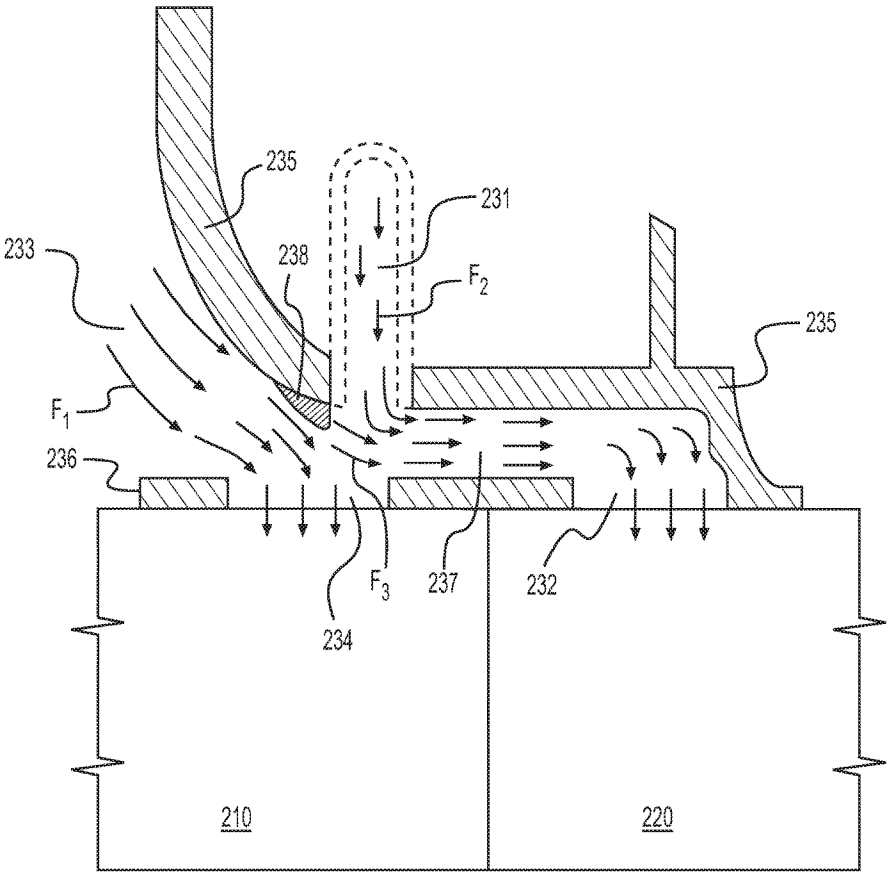
FIG. 4 is a schematic view illustrating a mounting arrangement between a coolant pump, a block and a head of an engine.

Furthermore, as illustrated in FIGS. 3-4, the coolant pump 230 in one form of the present disclosure may include: the main inlet 233, the bypass inlet 231, the first outlet 232 through which the coolant flows into the block 220, and a second outlet 234 through which the coolant is supplied to the head 210 of the engine, respectively. With this arrangement, the coolant pump 230 may separate a first coolant flow coming through the main inlet 233 of the coolant pump from a second coolant flow coming through the bypass inlet 231 of the coolant pump while limiting mixture of the first and second coolant flows, in a joining area 237, to a small amount based on a temperature of coolant discharged from the block 220 via the block coolant discharge line 104. The bypass thermostat 203 controls the flow of the coolant discharged from the block coolant discharge line 104 based on the temperature of the block coolant.

Once coolant supplied through the main inlet 233 and the bypass inlet 231, the coolant is guided to the head 210 and block 220 through the joining area 237 which is formed inside of the coolant pump 230. In detail. a housing 235 of the coolant pump and a mounting wall 236 of the coolant pump form the joining area 237 where the coolant (i.e., coolant flow $F_2$) supplied through the bypass inlet 231 is guided to the engine block 220 through the first outlet 232 and the coolant (i.e., coolant flow $F_1$) supplied through the main inlet 233 is guided to the engine head 210 through the second outlet 234.

Moreover, the joining area 237 includes a narrow neck portion 238, and the narrow neck portion 238 may be in a form of a raised portion of the housing 235 toward the joining area 237. In one form, the narrow neck portion 238 may be disposed between the main inlet 233 and the bypass inlet 231 or may be adjacent to the bypass inlet 231 so as to cause the Venturi syphon effect on the coolant while passing the joining area 237.

Since the narrow portion 238 provides a constricted section of the joining area through the coolant flows, the speed of the coolant (i.e., coolant $F_3$) passing the narrow portion 238 becomes faster than in other sections, thereby causing low pressure to suction other fluids (i.e., coolant $F_2$).

More specifically, referring to FIG. 4, because of the Venturi syphon effect on the coolant caused by the narrow neck portion 238, a small portion (i.e., coolant flow $F_3$) of the first coolant flow $F_1$ is induced toward the second coolant flow $F_2$ and mixed with the second coolant flow $F_2$ which comes in through the bypass inlet 231. The mixed coolant and the second coolant flow (i.e., $F_2$ and $F_3$) are supplied to the block 220 through the first outlet 232. In other words, most of the coolant (i.e., coolant flow $F_1$) flowing through the main inlet 233 flows out through the second outlet 234 connected to the head coolant line 111 while only a small portion of coolant (i.e., coolant flow $F_3$) flows across and is mixed with the coolant flow $F_2$. The mixed two coolant flows (i.e., coolant flow $F_2$ and $F_3$) flow out through the first outlet 232 connected to the block coolant line 102 and flow into the block 220. As a result, the coolant circulating the block is isolated from the coolant circulating the head as long as the bypass thermostat 203 directs the block coolant to flow through the block coolant return line 106. As discussed above, by limiting the mixture of the coolant until coolant circulating the block reaches at a predetermined temperature, the engine (i.e., engine head) warm up time is shorten and the temperature gradient in the coolant across the block is reduced.

Once the coolant circulates in the head and block through the head coolant line 111 and the block coolant line 102, respectively, the coolant is discharged from the engine and returned to the coolant pump 230 through coolant return lines (e.g., return line 106, 113, 119). More details will be described below with reference to FIG. 1.

In general, coolant discharged from an engine block in a conventional cooling system is always mixed with the coolant discharged from an engine head regardless of the temperature of the coolant discharged from an engine block. As a result, the time to warm up the engine head delays in a cold start condition due to the low temperature of coolant discharged from the engine block and thus the efficiency of the fuel is undermined.

However, as illustrated in FIG. 1, the cooling system 100 in one form of the present disclosure includes a block coolant return line 106 which directly connects a bypass thermostat 203 to the bypass inlet 231 of the coolant pump 230. Thus, the block coolant return line 106 guides the block coolant, which is discharged from the block through the block coolant discharge line 104 and the bypass thermostat 203, to the bypass inlet 231 until the temperature of the block coolant reaches at a predetermined temperature (e.g., a full engine warm up temperature). FIG. 1 illustrates coolant flows in the cold start condition. The solid lines indicate coolant flowing through the corresponding coolant lines, whereas the dotted lines denote that coolant flow is blocked.

With the arrangement of the cooling system as described above, the block coolant separately returns to the coolant pump 230 through the block coolant return line 106, and the head coolant returns to the coolant pump 230 through the first, second, and third coolant return lines 113, 117, 119 so that the block coolant and head coolant are not mixed in the return lines. Instead, only small portion of the two coolant flows (i.e., block coolant and head coolant) is mixed in the joining area 237 formed inside of the coolant pump 230. In particular, the second coolant return line 117 is disposed between the main thermostat 202 and the coolant pump 230 and may guide the coolant to the coolant pump 230.

For example, when the bypass thermostat 203 is open to the block coolant return line 106 (i.e., a closing state of the bypass thermostat), and the head coolant feeds in the main inlet 233 through the first, second, and third coolant return lines 113, 117, 119. Once the temperature of block coolant reaches at the predetermined temperature and thus the bypass thermostat 203 closes the block coolant return line 106 (i.e., an open state of the bypass thermostat), the head coolant and the block coolant is mixed while flowing through the first, second, third coolant return lines 113, 117, 119, and supplied to the main inlet 233 of the coolant pump 230.

In detail, when the block coolant reaches at the predetermined temperature, the bypass thermostat 203 opens to the first coolant return line 113 and closes the block coolant return line 106. Thus, the block coolant flowing out from the block coolant discharge line 104 flows through the first coolant return line 113 and is mixed with the head coolant. The mixed coolant from the head and block flow into the main inlet 233 of the coolant pump 230 through the main thermostat 202. Since the main thermostat 202 closes a cooling line 208 connected to a radiator 207 until the mixed coolant temperature reaches at a temperature necessary to be cooled by the radiator, the mixed coolant circulates only through the first coolant return line 113. Once the mixed coolant temperature reaches at the temperature to be cooled, the coolant return line 113 is shut off by the main thermostat 202 and the mixed coolant from the head and block all flows through the radiator 207. The cooling line 208 connects the radiator 207 to the main thermostat 202 so that when the main thermostat 202 is opened at a preset temperature, the coolant is cooled by the radiator 207 and supplied to the coolant pump 230.

As discussed above with the exemplary forms, the present disclosure is directed to a cooling system that separately controls block coolant from head coolant while allowing only a minimum level of coolant mixture in the coolant pump until the block coolant is warmed up. This coolant control strategy provides improvement in engine performance and durability compared to a conventional cooling system, in particular, under a cold-start condition.

In the cold-start condition, the temperature of the block coolant is much lower than the temperature of the head coolant, and the amount of the block coolant is significantly greater than the volume of the head coolant so that when the head coolant and block coolant is mixed together, the temperature gradient in the coolant is very large and thus coolant temperature control becomes difficult, the engine warm up is delayed. However, by limiting the mixture of the block coolant and head coolant as described above, the warm up of the head 210 in cold-start condition is fast, and the temperature gradient in the coolant is significantly reduced. As such, the rapid engine warm up improves the fuel efficiency and the reduced temperature gradient (i.e., improved block coolant temperature distribution) improves the durability of engine sealing parts such as a gasket, and sealant.

Although the present disclosure has been shown and described with respect to specific exemplary forms, it will be obvious to those skilled in the art that the present disclosure may be variously modified and altered without departing from the spirit and scope of the present disclosure.

What is claimed is:

1. A cooling system for an engine having a head and a block and a plurality of channels through which coolant passes, the head including a head coolant line and the block including a block coolant line for intake and discharge of coolant, the cooling system comprising:

a coolant pump mounted on the engine and having a main inlet, a bypass inlet, a first outlet configured to supply the coolant to the block, and a second outlet configured to supply the coolant to the head of the engine;

a main thermostat configured to receive the coolant discharged from the block and head of the engine;

a bypass thermostat configured to receive the coolant discharged from the block through a block coolant discharge line;

a first coolant return line configured to guide the coolant discharged from the head and block to the main thermostat;

a second coolant return line configured to connect the main thermostat to the main inlet of the coolant pump;

a block coolant return line configured to directly connect the bypass thermostat to the bypass inlet of the coolant pump, wherein the bypass thermostat is configured to selectively send the coolant discharged from the block to the bypass inlet of the coolant pump based on a temperature of the coolant circulating the block of the engine;

the coolant pump including a joining area formed by a housing of the coolant pump and a mounting wall of the coolant pump, and wherein the joining area is configured to guide the coolant supplied through the bypass inlet to the engine block through the first outlet and to guide the coolant supplied through the main inlet to the engine head through the second outlet; and wherein the joining area includes a narrow neck portion configured to cause a venturi syphon effect by which a small portion of the coolant flowing in through the main inlet is mixed with the coolant flowing in through the bypass inlet and supplied to the engine block.

2. The cooling system of claim 1, wherein the narrow neck portion is formed by a raised portion of the housing adjacent to the bypass inlet, the raised portion is disposed between the main inlet and the bypass inlet.

3. A cooling system for an engine having a head and a block, the cooling system comprising:

a plurality of channels through which coolant passes, the plurality of channels including a head coolant line formed in the head and a block coolant line formed in the block for intake and discharge of the coolant;

a coolant pump mounted on the engine, and configured to separate coolant flowing in through a main inlet of the coolant pump from coolant flowing in through a bypass inlet of the coolant pump and to limit mixture of the coolant flowing in through the main inlet and the bypass inlet to a small amount based on a temperature of coolant discharged from the block;

a main thermostat configured to control the coolant discharged from the block and head of the engine based on a temperature of the coolant discharged from the block and head;

a bypass thermostat configured to control the coolant discharged from the block through the block coolant discharge line based on a temperature of the discharged block coolant;

a first coolant return line configured to guide the coolant discharged from the head and block to the main thermostat a second coolant return line configured to connect the main thermostat to the main inlet of the coolant pump;

a block coolant return line configured to directly connect the bypass thermostat to the bypass inlet of the coolant pump, wherein the bypass thermostat is configured to selectively send the coolant discharged from the block to the bypass inlet of the coolant pump based on the temperature of the discharged block coolant;

wherein the coolant pump includes a first outlet and a second outlet, and the coolant pump includes a joining area formed by a housing of the coolant pump and a mounting wall of the coolant pump, and wherein the joining area is configured to guide the coolant supplied through the bypass inlet to the engine block through the first outlet and to guide the coolant supplied through the main inlet to the engine head through the second outlet; and wherein the joining area includes a narrow neck portion configured to cause a venturi syphon effect by which a small portion of the coolant flowing in through the main inlet is mixed with the coolant flowing in through the bypass inlet and supplied to the engine block.

* * * * *